United States Patent [19]

Lefkowitz

[11] Patent Number: 4,981,745

[45] Date of Patent: Jan. 1, 1991

[54] FORMING FABRIC FOR PAPERMAKING

[76] Inventor: Leonard R. Lefkowitz, 14 Alpine Dr., Latham, N.Y. 12110

[21] Appl. No.: 357,703

[22] Filed: May 26, 1989

[51] Int. Cl.[5] ..... B32B 5/16; D06N 7/04; D21F 1/10; D21F 1/30

[52] U.S. Cl. ..... 428/147; 428/237; 428/240; 428/283; 428/143; 428/323; 428/327; 162/DIG. 1; 162/348; 162/351

[58] Field of Search ..... 162/DIG. 1, 348, 351; 428/237, 240, 283, 143, 323, 327, 147

[56] References Cited

U.S. PATENT DOCUMENTS 4,251,928 2/1981 Rotar et al. ..... 162/DIG. 1 X 4,571,359 2/1986 Dutt ..... 428/240

FOREIGN PATENT DOCUMENTS 0004480 10/1979 European Pat. Off. ..... 162/351

41-14603 8/1966 Japan ..... 162/348

2250292 10/1987 Japan ..... 162/348

*Primary Examiner*—Ellis P. Robinson

*Assistant Examiner*—William P. Watkins, III

*Attorney, Agent, or Firm*—Kane, Dalsimer, Sullivan, Kurucz, Levy, Eisele & Richard

[57] ABSTRACT

An improved forming fabric for papermaking has discrete projections on the sheet forming side to improve fines retention and on the machine contact side, for improved resistance to wear.

3 Claims, 2 Drawing Sheets

FIG. 1
PRIOR ART
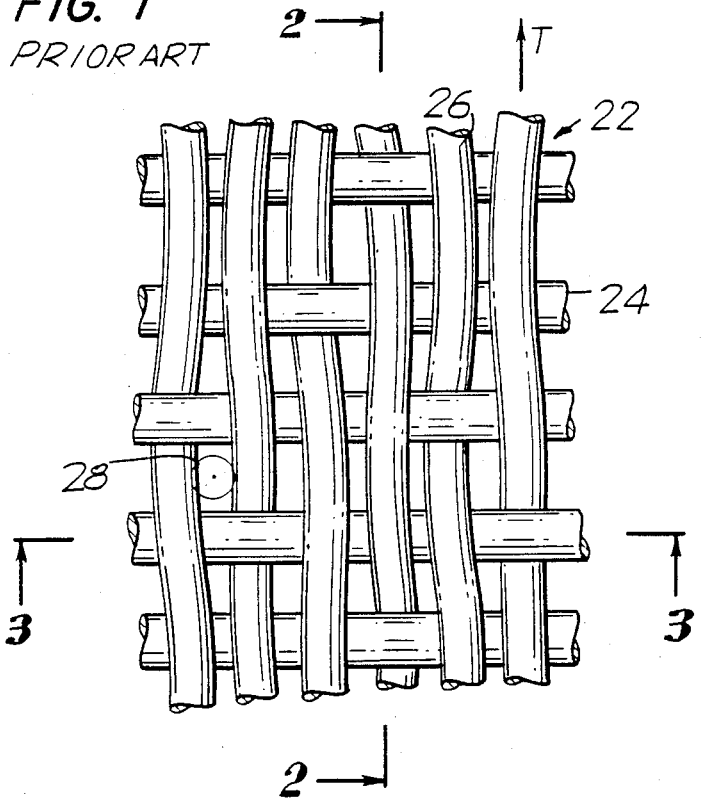
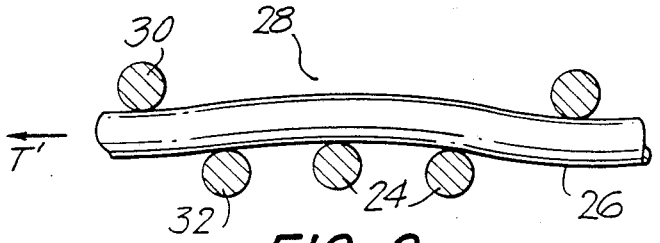
FIG. 2
PRIOR ART
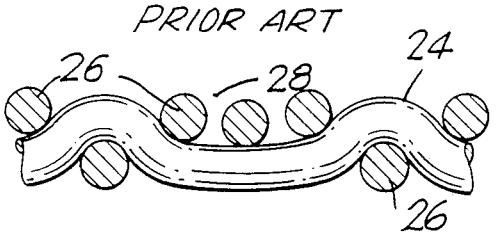
FIG. 3
PRIOR ART FIG. 4
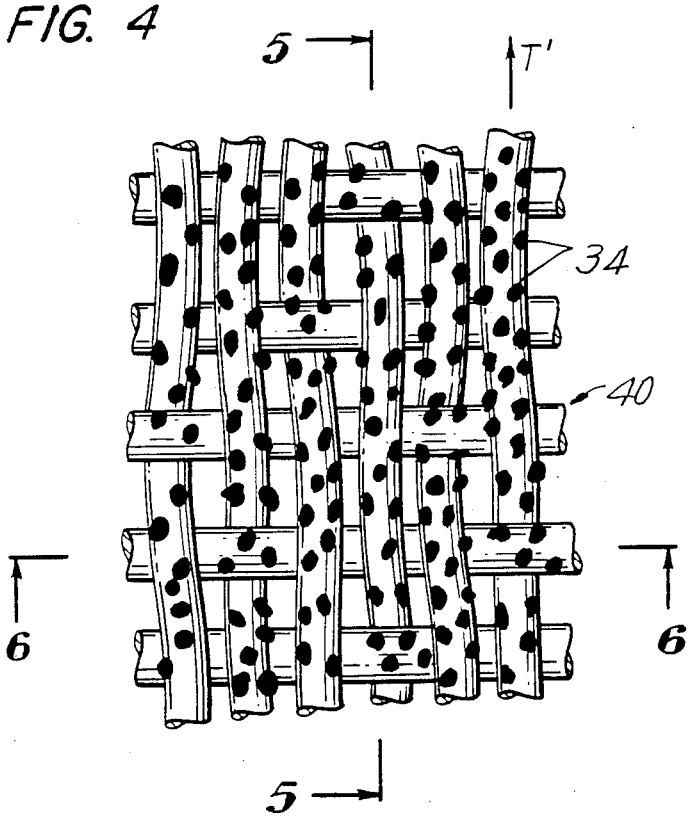
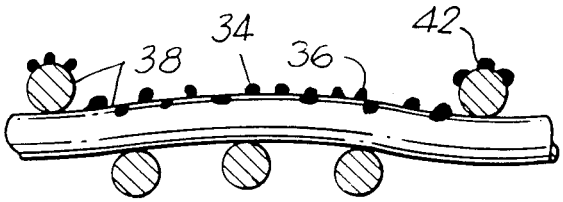
FIG. 5
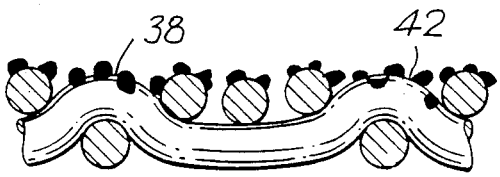
FIG. 6

FORMING FABRIC FOR PAPERMAKING

BACKGROUND OF THE INVENTION

Forming fabrics for papermaking have undergone significant changes in recent years stemming from a desire to form better quality sheets under conditions of increased operating speed and higher quality standards.

Traditionally, forming fabrics have been woven in a wide variety of single layer constructions, but it was found that such fabrics cannot provide adequate performance under certain operating conditions. For example, when single layer forming fabrics are designed with life expectancy as the chief criteria, coarse meshes and large yarns are used; however, such fabrics are frequently not capable of providing the optimum in terms of sheet formation, fines retention, and reduced sheet mark.

To achieve the best sheet properties, it has been found necessary to employ fabrics with finer mesh sheet contact surfaces. If such fabrics were made in single layer constructions, they would not provide adequate life.

In order to satisfy requirements for extended life as well as enhanced sheet quality, many of today's forming fabrics are manufactured in multiple layers, with large yarns and coarse meshes in the underside of the fabric to provdie wear resistance, and fine mesh, smaller yarns woven into the sheet contact layer of the fabric, to provide for increased fines retention and reduced sheet mark.

In the formation of the paper sheet, it has lately been shown that the furnish, which contains both fines and larger stock particles, does not form up in a smooth and continuous process as the sheet progresses along the forming table; rather, the furnish tends to be agitated during the formation process and as a consequence of the turbulance that occurs, a very significant portion of the fines fraction contained in the furnish is lost during formation. Rapid and turbulent drainage forces encountered during sheet formation cause repeated disturbances to the precoat which forms upon the forming fabric mesh, allowing for the repeated escape of fines during the early part of the drainage cycle.

Although the idea of using multiple layer forming fabrics has provided an improvement in sheet quality and fines retention, the cost of such fabric compared to single layer fabric is substantially greater owing to the added weaving time, the need for more expensive finer yarns, and the greater difficulty in achieving sufficient product perfection to satisfy papermaking needs.

Papermaking machines are being operated at much higher speeds today than they were in the recent past, placing severe demands upon the forming fabrics.

Despite the present trend toward multiple layer forming fabrics with larger yarns in contact with the machine side wear inducing elements, increased resistance to wear, even for such double and triple layer fabrics, is an objective of fabric makers called upon to provide the best service life possible for their customers.

In the case if single layer fabrics, the need to provide wear resistance as well as optimum sheet formation properties must be met in a single layer weave; however, substituting larger yarns automatically results in a coarser mesh fabric which will not form the same quality sheet that could be made on a finer mesh fabric.

Consequently, it is an object of this invention to provide a wear resistant coating to the machine contact side of double and triple layer fabrics to increase their resistance to wear.

It is a further object of this invention to provide a wear resistant coating to the machine contact side of single layer fabrics to increase their wear resistance or to permit the use of finer yarns with increased service life.

It is an object of this invention to provide a simpler, less expensive means to enhance the fines retention efficiency of single layer forming fabrics.

It is also an objective of this invention to improve still further the sheet formation and fines retaining ability of multiple layer forming fabrics.

During the formation of paper on forming fabrics, the furnish undergoes a redistribution through agitation and turbulence, with some agglomeration taking place as stock moves about and flows without restriction toward the nearest aperature in the forming fabric, taking fine particles of stock along with the flow. If some means could be found to restrain this free flow of the fines within the furnish liquid, sheet formation would be improved, and the sheet would possess more uniform properties from one side to the other.

It is an object of this invention to provide a forming fabric with enhanced particle arresting means in its sheet contacting surface so that a higher quality of sheet can be produced having improved fiber uniformity and reduced sheet two-sidedness.

It is an object of this invention to provide forming fabrics with useful sheet contact side appurtanences for the purposes of arresting the motion of fines and paper stock ingredients within the furnish on top of the forming media at the earliest possible opportunity to enhance sheet uniformity.

A common characteristic of paper is the presence of a wire mark caused by uneven movement of fibers on the forming wire, by indentation of sheet fibers into the interstices of the forming fabric, as well as by other means.

It is a still further objective of this invention to reduce the wire mark imparted to the sheet by the forming fabric.

BRIEF DESCRIPTION OF THE INVENTION

The preceding objectives may be realized when the sheet contact surface of a forming fabric is covered with a discontinuous layer of descrete space apart surface projections in the form of hemispheres, irregularly shaped particles, very short fibers or the like, aligned substantially in the vertical plane so as to intercept the particles in the furnish before they reach the interstices in the underlying base fabric. In this way, the sheet side projections act to arrest the motion of particles deposited upon the forming fabric at their initial point of contact, thereby arresting sheet particle motion above the original fabric surface and assisting in preventing the escape of sheet particles through the interstices of the underlying fabric support layer.

Forming fabrics are subject to wear by sliding friction on the machine contact side of the fabrics. Many attempts have been made in the past to improve the wear resistance of forming fabrics by resin treatment, by the inclusion of wear resistant yarns, and through the use of large yarns in the machine contact side of the fabric; however, the need still exists to improve wear resistance through more effective means.

One objective of the invention is provide wear resistant forming fabrics by covering the machine contacting fabric surfaces with a discontinuous coating of descrete spaced apart projections having wear resistant properties. Such projections may be in the form of hemispheres, irregularly shaped particles or the like, arranged so that the projections come into contact with wear inducing machine surfaces before the original fabric surfaces, thereby delaying the onset of fabric wear until the projections are worn down.

In one preferred embodiment of the invention, the sheet side surfaces of the forming fabric would be covered with spaced apart projections intended to deter fines loss and improve sheet formation, while the machine contact surface of the same forming fabric would be covered with wear resistant projections to improve fabric life.

DESCRIPTION OF THE DRAWINGS

This invention may be clearly understood by reference to the attached drawings in which:

FIG. (1) is a fragmentary plan view of a forming fabric embodying of the prior art;

FIG. (2) is a sectional view along the line 2—2 in FIG. (1);

FIG. (3) is a sectional view along the line 3—3 in FIG. (1);

FIG. (4) is a fragmentary plan view of a fabric embodying the teachings of the present invention;

FIG. (5) is a sectional view along the line 5—5 in FIG. (4);

FIG. (6) is a sectional view along the line 6—6 in FIG. (4).

DETAILED DESCRIPTION OF THE INVENTION

FIGS. (1), (2), and (3) show a prior art single layer forming fabric of the type described in U.S. Pat. No. 3,858,623, which comprises monofilament yarns woven endless so that the warp yarns 24 extend in the cross machine direction and the filling yarns 26 extent in the machine direction which is depicted by the arrow T'.

In this prior art example, there are 32 yarns/cm in the machine direction providing a center to center distance of 0.31 mm and 20 yarns/cm in the cross machine direction providing a center to center distance of 0.5 mm. Typically, there are between 20 and 30 strands/cm in single layer fabrics, so that the average center to center distance between strands ranges between 0.33 mm and 0.5 mm.

This prior art single layer fabric is woven in a four harness satin weave, where cross machine direction yarns interlace with every fourth machine direction yarn. As can clearly be seen in FIGS. (2) and (3), this interlacing pattern prevents the yarns from forming a flat surface for sheet formation. For example, it is not likely that a fiber may readily bridge between adjacent cross machine direction yarns at positions 30 and 32 since they do not reside in a single plane with respect to the furnish deposited upon the fabric surface.

The average length of softwood fibers is 3 mm–3.5 mm, whereas hardwood fibers average about 1.0 mm. With all prior art fabrics, it is known that for fibers to build up on the support fabric, the fibers must be considerably longer than the center to center distance between support strands in the sheet contact surface to achieve an appreciable probability of the fiber being retained on the strands. It is also well known that only after this initial bridging across support strands in the fabric can the fines present in the furnish be captured, since the fines are equal to or less than 75 micrometers in length and could not possibly bridge across strands in the forming fabric by themselves. This can be understood more clearly by noting the relative size of a fines particle 28 compared to the strand to stand distances in FIGS. (1), (2), and (3).

FIG. (4) shows one preferred form of the present invention, where sheet contact surfaces of the prior art forming fabric are covered with a discontinuous layer of spaced apart surface projections in the form of hemispheres 34.

In one preferred manufacturing method, such particles may be comprised initially of solid microspheres having a fusable sheath and a higher melting temperature core or a non melting core. The forming fabric may first be raised above the microsphere sheath melting temperature, at which time the microspheres are evenly dispersed onto the forming fabric surface where they become hemispherical in shape upon sheath melting. The hemispheres adhere permanently upon cooling of the fabric. Even dispersion of the particles may be assured by means such as electrstatic deposition assisted by air pressure or vaccuum pressure. Other ways or accomplishing the same purpose may prove equally efficient in achieving this type of descrete particle surface.

The surface projections 36 are positioned about the sheet contact surfaces 38 of the forming fabric 40. When sheet particles contact the projections, they are arrested in their flow path and sheet formation begins with much less loss of fines. Fibers moving on top of the forming fabric at great speed jam up against the projections and are arrested. The projections are arrangd in such manner that sheet removal is not adversely affected by their presence, and for this reason, it is preferable that the projections be free of crevaces at their point of adhesion 42 to the base fabric.

It should be noted in particular that sheet fiber motion is arrested by surface projections which do not reduce the fluid flow capacity of the underlying fabric mesh. The principle of arresting fiber motion in the sheet above the surface of the forming fabric and prior to dewatering the sheet through the underlying fabric mesh is new. The sheet contact surface projections of the invention provide more of a combining action than a filtration action in that there is no water removal taking place above the forming fabric and there are no true pore spaces between the sheet side appurtenances.

A pore space is defined as a hole or cavity which permits communication between one surface and another, in the case of filters, for the separation of liquids from solids. In the case of the sheet side projections, pores are not usually formed between such adjacent members. The projections function because, on a micro scale, it is obvious that in order for liquid to leave the sheet side of the fabric, it must first travel down in between the strands in the base layer and to do so, at least some of that furnish liquid must first move in a transverse plane in order to attain access to the desired drainage outlet. It is during this transverse motion in the plane of the fabric that the surface projections act to arrest particle motion, thereby contributing to early sheet formation, the reduction of fines losses, and the improvement of sheet uniformity.

In multi layer woven forming fabrics, the smallest monofilament that may be considered practical for use in the fine mesh sheet contact surface is in the range of from 125 to 150 micrometers. A fine mesh surface may have an upper practical limitation of about 10,000 pore spaces per square inch. In the case or flock fibers, as many as 300,000 vertically oriented individual flock fibers may be fitted within one square inch, so that the potential benefit of the combing and arresting action of the sheet side vertically oriented projections may be very significant. For example, even at a much lower density of 90,000 flock fibers per square inch, this would result in an average span to span distance between adjacet projections of only 75 micrometers.

With close spaced sheet surface projections, fines may be efficiently arrested above the forming fabric surface, thereby reducing loss of fines through the fabric. The practical density of sheet side projections will depend upon durability and paper making considerations. Selections here will afford the design engineer one more means of providing the papermaker with optimum forming fabrics at economical cost. For effective results, the number of descrete sheet side projections should exceed the number of pore spaces in the sheet contact layer of the base fabric.

Although not as yet ascertained, it is likely that the presence of these sheet side projections will also alter the fiber alignment in the sheet in important ways, reducing the disparity between machine direction and cross machine directions sheet properties. In most cases, fibers have a tendency to align in the machine direction, causing a very significant difference in sheet tear strength and tensile strength between machine and cross machine directions. Through the use of sheet contact surface projections, a new means of influencing these directional paper properties is introduced. communication between one surface and another, in the case of filters, for the separation of liquids from solids. In the case of sheet side projections, pores are not usually formed between such adjacent members. The projections function because, in order for liquid to leave the the sheet side of the fabric, the liquid must pass down in between the strands of the base fabric and to do so, at least some of the liquid furnish must first travel in a transverse plain above the surface yarns in order to attain access to a drainag outlet. It is during this transverse motion in the plane of the fabric that the surface projections act to arrest furnish particle motion, causing particles to jam up against the projections as the liquid continues to pass between projections and filters into and through the underlying mesh. Although not wishing to be bound by any single theory, it is presumed that through this mechanism, the sheet side projections contribute to early sheet formation, the reduction of fines losses, and the improvement in sheet uniformity.

The preferred size for the projections to be applied to forming fabric surfaces lies in the range of from 25 to 100 micrometers. Many such projections may be applied compared to the number of yarns that could be woven into a forming fabric. For example, one manufacturer of electrostatic flocking equipment states that dense flock may be applied to a fabric with as many as 300,000 fibers per square inch. While vertically oriented flock fibers may not be ideally suited to this application because of the possibility that they may cause sheet picking problems, nevertheless, the impressive number of individual members that can be fitted into a given area by the electrostatic flocking technique may be typical of other types of electrostatically applied particles such as powders.

In the preferred case, descrete particles in the size range of from 15 to 100 micrometers would be electrostatically conveyed and deposited upon a forming fabric surface that had first been rendered tacky by adhesive applicaion such that the deposited particles could be maintained in the initially deposited position until more permanent attachment means could be applied. For example, the initial tacky adhesive might be activated to form a permanent binder by elevated temperature curing.

The electrostatic method of particle deposition is a preferred method because the electric charges present automatically result in a high degree of spacing uniformity for the particles on the base fabric.

For added particle adhesion, the particles themselves might comprise a heat activated adhesion material, or the outer surface of the particles would be fusion bondable to the substrate fabric surface.

In the case of particles attached to the sheet forming surface of the fabric, it is important that such particles possess a smooth exterior surface so that sheet release will not be impaired by the projections. Particles preferably would be either hemispherical or spherical in shape to present only a minimum possibility of interfering with the smooth release of the sheet after formation.

The potential benefit of a multitude of closely spaced projections on the sheet side surface of the fabric can be significant with respect to the arresting of fiber motion in the sheet being formed on the fabric, and the reduction in loss of fines through the fabric.

New technology has emerged in the area of thermal spraying whereby very small metal, ceramic, and plastic particles can be intensely heated momentarily and then spray coated onto metal, ceramic and plastic surfaces. Such particles can adhere very tenaciously to the substrate, depending upon the nature of the materials involved, the preparation of the surface to be coated, and the precise conditions used to effect the treatment; adhesion of the thermal spray coating is thought to occur through mechanical embedment, heat fusion, chemical, and a combination of all these mahcnisms.

One of the characteristics of thermal spray coatings particularly beneficial to the forming fabric application is that the coating may be applied in the form of closely controlled particles over the size range of from 20 to 100 micrometers. It is also characteristic of thermal spray coatings that particles tend to space themselves apart from each other, and this may be due to electric charges present during the coating application.

A single layer conventional forming fabric was thermally spray coated at the TAFA facilities in Concord, N.H. The coating was applied to both sheet side and wear side of the fabric using a zinc metal material. A relatively coarse particle size was applied using the thermal arc spraying technique such that both surfaces of the fabric were coated with particles in what appeared superficially to be a continuous coating. However, the coating actually consisted of descrete particles of metal with micro crevaces between them. The appearance of the coating was a bumpy surface with distinct hills and valleys throughout the entire coated surface. The small discontinuities allow the metal coating to flex. The small crevaces also act as water receptors to permit lubrication of friction surfaces during operation. The uneven coating height creates a surface of projections useful in the sheet forming application.

The zinc coated fabric was evaluated in comparison to the original untreated control single layer forming fabric using the dynamic drainage jar, described by Britt el al in their within the particle size range of from 15 to 100 micrometers in average dimensions, and would possess high melt viscosity such that upon fusion bonding to the substrate contact surface, the particles would not melt into a continous smooth film but would remain as descrete particles, fusing and assuming a hemispherical shape having an expanded contact area with the base fabric surface.

Another alternative would be the use of custom made microspheres having a core which did not fuse or only fused at high temperatures, and a sheath that could be fusion bonded without disturbance to core or to base fabric. In this case, microspheres of from 25 to 75 micrometers in diameter would be formed and deposited on the surface to be coated by electrostatic means. In order to insure that the particles remain in the same position as deposited, it may be necessary to first coat the fabric surfaces with a tacky adhesive. Later, the adhesive would be dried and cured. Simultaneously, the microsphere sheath would be fusion bonded to the substrate fabric to accomplish a permanent coating.

The embodiments which have been described herein are but some several which utilize this invention and are set forth here by was of illustration but not of limitation. It is apparent that many other embodiments which will be readily apparent to those skilled in the art may be made without departing materially from the spirit and scope of this invention

I claim:

1. An improved forming fabric with enhanced particle arresting means for a papermaking machine, said forming fabric comprising a base fabric layer having a paper contact surface, wherein the improvement comprises a plurality of spaced apart discrete particles adhered to said paper contact surface.

2. An improved wear resistant forming fabric for a papermaking machine, said forming fabric comprising a base fabric layer having a machine contact surface, wherein the improvement comprises a plurality of discrete spaced apart particles adhered to said machine side contact surface.

3. The forming fabric of claim (1) or claim (2) where the average size of the particles is in the range of from 15 to 125 micrometers.

* * * * *